US009366039B2

(12) United States Patent
Luo et al.

(10) Patent No.: US 9,366,039 B2
(45) Date of Patent: Jun. 14, 2016

(54) FLOORBOARD

(71) Applicant: Fuzhou Yilida Wood Industry Co., Ltd., Fuzhou (CN)

(72) Inventors: Shengquan Luo, Wulumuqi (CN); Jianyong Bi, Beijing (CN)

(73) Assignee: FUZHOU YILIDA WOOD INDUSTRY CO., LTD., Fuzhou, Fujian (CN)

( * ) Notice: Subject to any disclaimer, the term of this patent is extended or adjusted under 35 U.S.C. 154(b) by 0 days.

(21) Appl. No.: 14/834,447

(22) Filed: Aug. 25, 2015

(65) Prior Publication Data

US 2016/0108625 A1 Apr. 21, 2016

(30) Foreign Application Priority Data

Oct. 16, 2014 (CN) ..... 2014 2 0599260 U

(51) Int. Cl.
*E04F 15/10* (2006.01)
*E04F 15/02* (2006.01)

(52) U.S. Cl.
CPC ..... *E04F 15/107* (2013.01); *E04F 15/02038* (2013.01); *E04F 2201/0107* (2013.01); *E04F 2201/0547* (2013.01)

(58) Field of Classification Search
CPC ... E04F 15/107; E04F 15/02038; E04F 15/10; E04F 2201/0107; E04F 2201/0547; E04F 2201/091; E04F 2201/095
See application file for complete search history.

(56) References Cited

U.S. PATENT DOCUMENTS 3,310,919 A * 3/1967 Bue ..... E01C 9/08 52/127.11
3,859,000 A * 1/1975 Webster ..... B63B 35/34 14/27
5,950,378 A * 9/1999 Council ..... E01C 13/045 52/177
6,694,691 B2 * 2/2004 Ku ..... E01C 5/223 52/403.1
7,543,417 B2 * 6/2009 McIntosh ..... E04F 15/02 52/177
7,546,707 B1 * 6/2009 DiGennaro ..... E04F 15/02 404/34
7,779,602 B2 * 8/2010 Collison ..... E04F 15/02 52/177
7,849,642 B2 * 12/2010 Forster ..... E01C 5/20 52/177
8,146,319 B2 * 4/2012 McIntosh ..... E04F 15/02 52/506.07

(Continued)

*Primary Examiner* — Joshua J Michener
*Assistant Examiner* — Alp Akbasli
(74) *Attorney, Agent, or Firm* — Leong C. Lei

(57) ABSTRACT

A floorboard includes a floorboard main body and a plastic edge frame. The plastic edge frame is configured to wrap the periphery of the floorboard main body. The back of the plastic edge frame is provided with a guide rail. The guide rail is provided with plastic slide blocks. The plastic slide blocks are matched with the guide rail of the plastic edge frame of another corresponding adjacent floorboard. A length defined between two adjacent plastic slide blocks on the same guide rail is greater than the length of each plastic slide block. The floorboard main body includes a wear-resisting layer, a decoration layer, a particleboard layer, and a balanced layer which are arranged from up to bottom. A top surface of the plastic edge frame is hidden under the decoration layer.

11 Claims, 4 Drawing Sheets

(56) References Cited

U.S. PATENT DOCUMENTS 8,726,603 B2 * 5/2014 Huang ..... E04F 15/02 52/591.1
2002/0189176 A1 * 12/2002 Stegner ..... E01C 5/20 52/177
2004/0035077 A1 * 2/2004 Martensson ..... E04B 1/6129 52/578
2005/0166513 A1 * 8/2005 Vanderhoef ..... E04F 15/10 52/578
2005/0208255 A1 * 9/2005 Pervan ..... B32B 21/02 428/60
2006/0185297 A1 * 8/2006 Mei ..... E04F 15/022 52/506.05
2009/0031658 A1 * 2/2009 Moller, Jr. ..... E01C 5/20 52/403.1
2009/0031662 A1 * 2/2009 Chen ..... C04B 26/08 52/515
2009/0193748 A1 * 8/2009 Boo ..... B27F 1/02 52/589.1
2011/0146177 A1 * 6/2011 Hannig ..... E04F 15/02 52/309.3
2012/0011791 A1 * 1/2012 Lach ..... A47G 27/0293 52/309.3
2012/0240506 A1 * 9/2012 Zhu ..... E04F 15/02 52/588.1
2012/0317911 A1 * 12/2012 Huang ..... E04F 15/02 52/309.1
2015/0082730 A1 * 3/2015 Atkinson ..... E04F 15/105 52/588.1

* cited by examiner

FLOORBOARD

BACKGROUND OF THE INVENTION

1. Field of the Invention

The present invention relates to a floorboard, and more particularly, to a floorboard having a plastic edge connecting structure.

2. Description of the Prior Art

Traditional wood floorboards are assembled by means of a mortising structure provided at the periphery and bottom of each floorboard by machining. The mortising structure occupies about 5 mm of wood. This not only wastes timber but also reduces the area of the floorboard especially for solid wood floorboards. The price of solid wood flooring is high, which results in that the cost of the floorboard is high. Besides, the investment in the processing machinery and equipment is large. The accuracy of the working of floorboards is not high. The mortising structure needs hard timber, hindering the development of the wood industry.

In addition, wood floorboards are classified according to the structure and material of the floorboards. In general, floorboards are classified into solid wood floorboards, compound wood floorboards, laminated wood floorboards, bamboo floorboards, and so on. Although there are particleboards on the market, they are mostly used for the production of furniture, such as wardrobes, cabinets, etc. So far, there are no particleboard floorboards on the market. The structure of the particleboard is soft, not meeting the requirement of tongue-and-groove, so it cannot be used as flooring.

The tongue-and-groove of the mortising structure of the traditional wood floorboard is exposed, which is likely to cause the release of formaldehyde. For the solid wood floorboard, because of its own shrinkage, it is very easy to have a crack phenomenon. With the change of the seasons, moisture and water may enter the floorboard from the tongue-and-groove at the periphery of the floorboard. The tongue-and-groove at the periphery of the floorboard absorbs moisture to expand, which results in that the surface of the floorboard is easy to roll up or peel off to reduce the life of the floorboard.

There is a developed wood floorboard on the market. The wood floorboard is provided with a plastic lock around the periphery of the wood floorboard, which changes the lock structure and the assembly way of the existing floorboards. It is convenient for production and assembly. The plastic lock is an exposed edge structure, namely, the plastic lock is directly exposed on the upper surface of the wood floorboard. When assembled, two plastic locks are buckled together so the exposed area is double. This impacts the appearance of the wood floorboard greatly. If the structure can be improved and applied to particleboards or density fiberboards, an innovated floorboard can be developed. That is, the floorboard can be developed to a new field. The material can be obtained conveniently to save the cost of the floorboard greatly, achieving a higher level of environmental protection.

SUMMARY OF THE INVENTION

The primary object of the present invention is to provide a floorboard. A plastic edge frame is designed to be a downward hidden structure to combine with a solid wood floorboard, a particleboard, or a density fiberboard, without having the arrangement of tongue-and-groove. The present invention can lower the cost, and be assembled and disassembled easily and environmentally-friendly, and prolong the service life of the product, and won't influence the appearance of the floorboard to achieve a higher level of environmental protection.

In order to achieve the aforesaid object, the floorboard of the present invention comprises a floorboard main body and a plastic edge frame. The plastic edge frame is configured to wrap the periphery of the floorboard main body. The back of the plastic edge frame is provided with a guide rail. The guide rail is provided with plastic slide blocks arranged evenly and each having an outer end extending out of a guide rail surface of the guide rail. The plastic slide blocks are matched with the guide rail of the plastic edge frame of another corresponding adjacent floorboard. When assembled, the plastic slide blocks slide along the guide rail surface until the plastic slide blocks of the two assembled floorboards are engaged with each other to be positioned. A length defined between two adjacent plastic slide blocks on the same guide rail is greater than the length of each plastic slide block. The plastic slide blocks at two opposing sides of the floorboard main body are dissymmetrical. Wherein the floorboard main body comprises a wear-resisting layer, a decoration layer, a particleboard layer, and a balanced layer which are arranged from up to bottom and a top surface of the plastic edge frame is hidden under the decoration layer; or wherein the floorboard main body comprises a wear-resisting layer, a decoration layer, a density fiberboard layer, and a balanced layer which are arranged from up to bottom and a top surface of the plastic edge frame is hidden under the decoration layer; or wherein the floorboard main body comprises a wear-resisting layer, a decoration layer, a multi-layer solid wood board layer, and a balanced layer which are arranged from up to bottom and a top surface of the plastic edge frame is hidden under the decoration layer.

Preferably, an outer edge of each plastic slide block is provided with a first flange upward and a first groove formed at an inner side of the first flange.

The guide rail surface is provided with a second flange downward and a second groove formed at an inner side of the second flange. The first flange is slidably matched with the second groove. The second flange is slidably matched with the first groove. The first flange and the second flange are disposed in a discontinuous relationship. The length of a spaced portion is equal to or slightly greater than the length of a continuous portion.

Preferably, each plastic slide block has a rectangular shape and is formed with a chamfer at an outer side thereof, and the back of each plastic slide block is provided with a recess.

Preferably, the particleboard layer is one of a wood particleboard layer, a bamboo particleboard layer, and a straw particleboard layer.

Preferably, the multi-layer solid wood board layer is laminated by multiple solid wood board layers arranged in an interlacing way.

Preferably, the wear-resisting layer is one of a wear-resisting paint layer and an aluminum oxide layer, and the decoration layer is one of a decoration paper layer and a veneer layer.

The advantages of the present invention are described hereinafter. The periphery of the floorboard of the present invention is combined with the plastic edge frame, without having the arrangement of tongue-and-groove, so as to supplement the strength of the particleboard layer. The top surface of the plastic edge frame is hidden under the decoration layer. The plastic edge frame is designed to be a downward hidden structure, not exposing to influence the appearance of the floorboard. The present invention can lower the cost, and be assembled and disassembled easily and environmentally-friendly, and prolong the service life of the product. Furthermore, the main body layer of the floorboard can be constituted by a particleboard layer, a density fiberboard layer, a multi-layer solid wood board layer, and the like. There are various forms. The particleboard layer can be a wood particleboard layer, a bamboo particleboard layer, or a straw particleboard layer. It is very convenient to get the material of the floorboard, so the cost of the floorboard can be decreased greatly to achieve a higher level of environmental protection.

DETAILED DESCRIPTION OF THE PREFERRED EMBODIMENTS

Embodiments of the present invention will now be described, by way of example only, with reference to the accompanying drawings.

Figure 1:
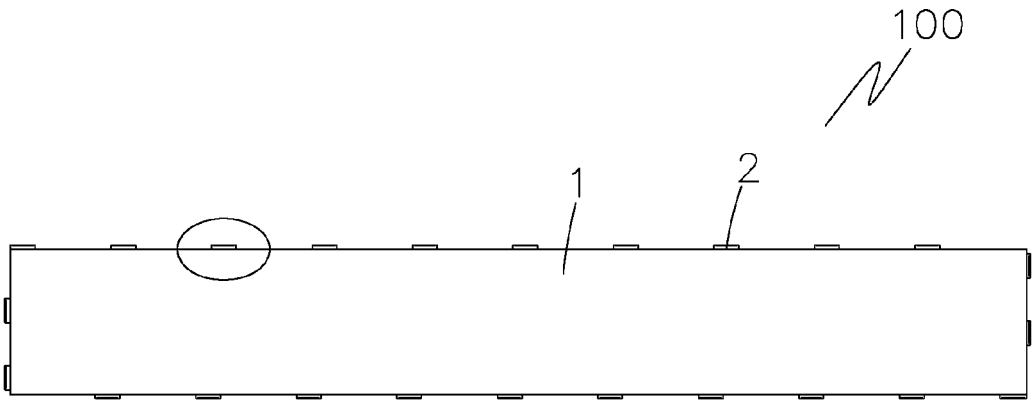
FIG. 1 is a front view of a floorboard according to a preferred embodiment of the present invention.
Figure 1A:
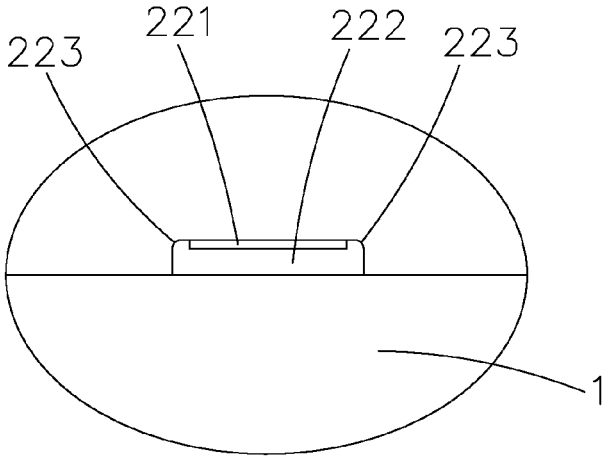
FIG. 1A is a partial enlarged view of FIG. 1.
Figure 2:
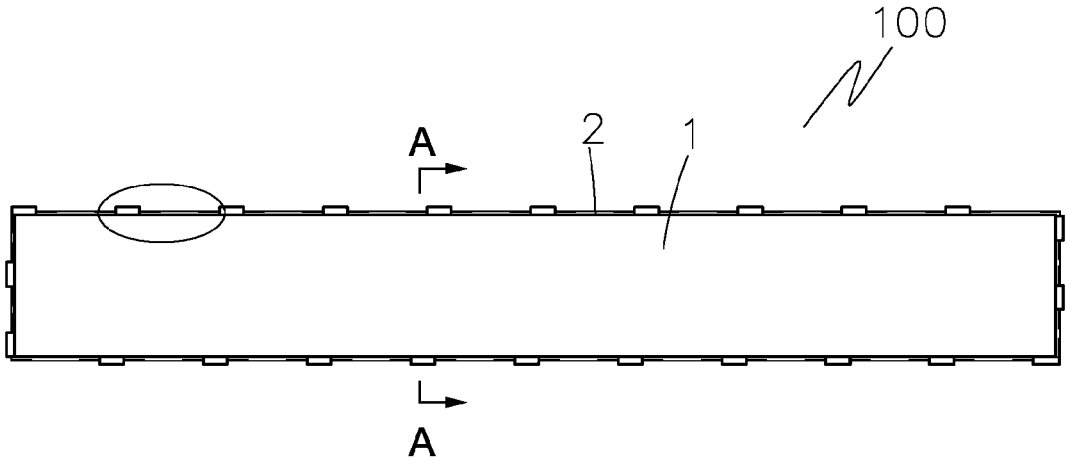
FIG. 2 is a rear view of the floorboard according to the preferred embodiment of the present invention.
Figure 2A:
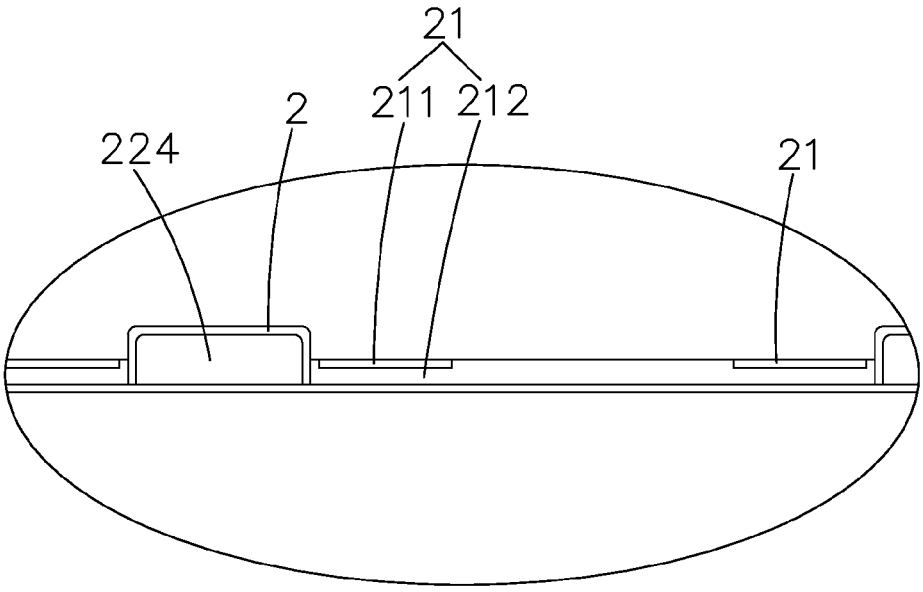
FIG. 2A is a partial enlarged view of FIG. 2.
Figure 3:
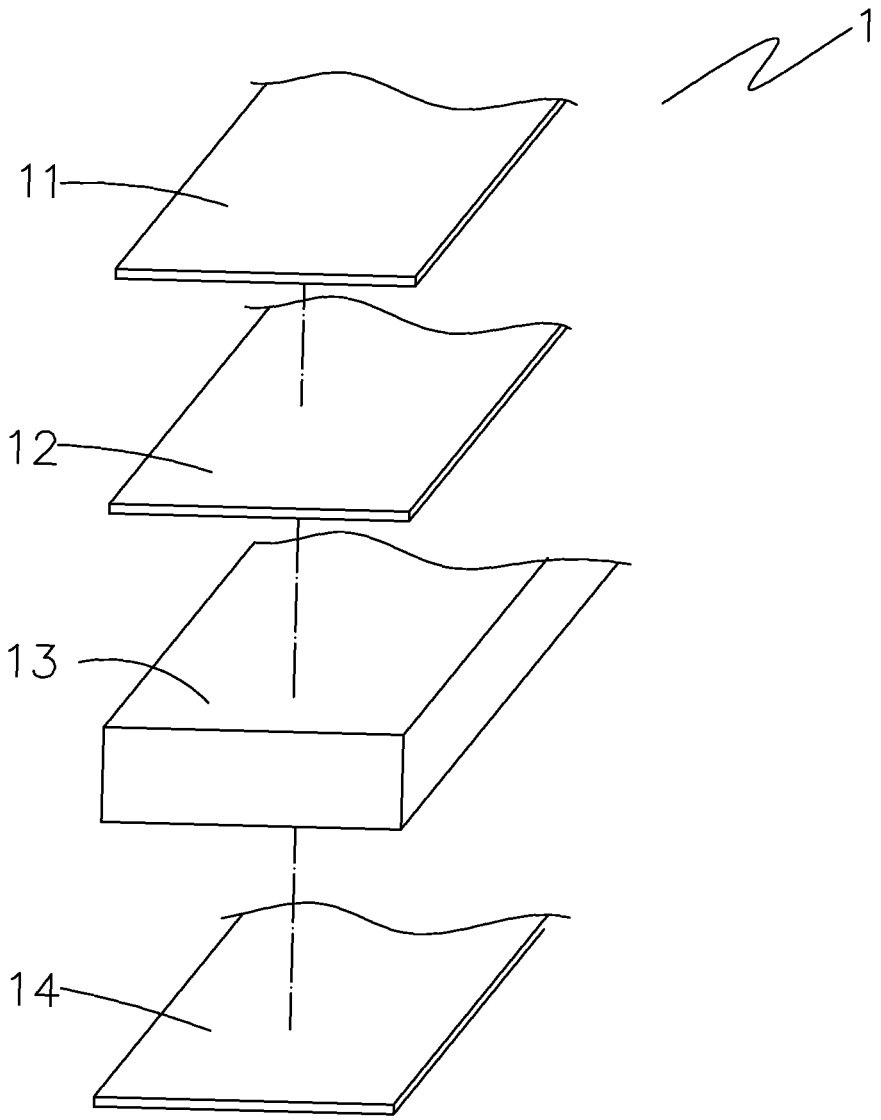
FIG. 3 is an exploded view of the floorboard according to the preferred embodiment of the present invention.
Figure 4:
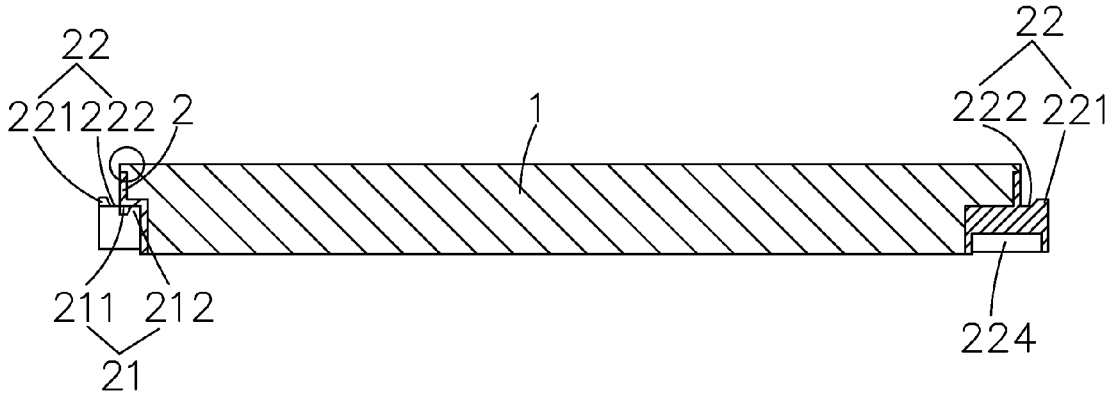
FIG. 4 is a sectional view taken along line A-A of FIG. 2.
Figure 5:
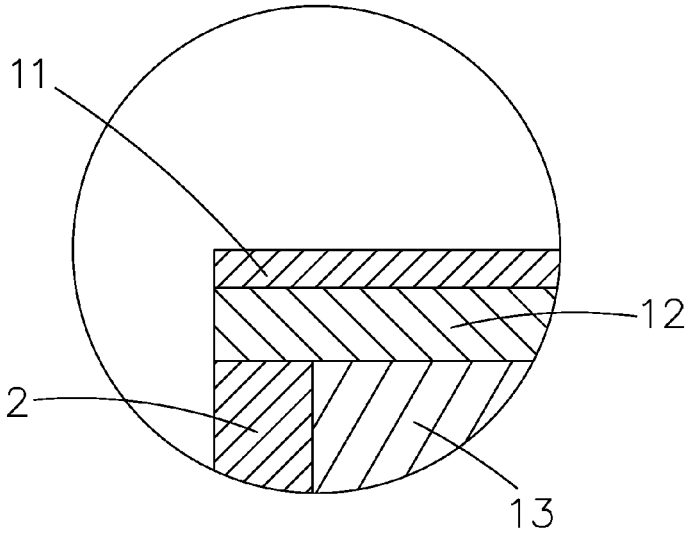
FIG. 5 is a partial enlarged view of FIG. 4.

As shown in FIG. 1 through FIG. 5, the present invention discloses a floorboard 100. The floorboard 100 comprises a floorboard main body 1 and a plastic edge frame 2. The floorboard main body 1 comprises a wear-resisting layer 11, a decoration layer 12, a particleboard layer 13, and a balanced layer 14 which are arranged from up to bottom. The plastic edge frame 2 is configured to wrap the periphery of the floorboard main body 1. A top surface of the plastic edge frame 2 is hidden under the decoration layer 12. The back of the plastic edge frame 2 is provided with a guide rail 21. The guide rail 21 is provided with plastic slide blocks 22 which are arranged evenly and each have an outer end extending out of a guide rail surface. A length defined between two adjacent plastic slide blocks 22 on the same guide rail 21 is greater than the length of the plastic slide block 22. The plastic slide blocks 22 at two opposing sides (for example, upper and lower sides or left and right sides) of the floorboard main body 1 are dissymmetrical (namely, they are staggered). The plastic slide blocks 22 are matched with the guide rail 21 of the plastic edge frame 22 of a corresponding adjacent floorboard. When assembled, the plastic slide blocks 22 slide along the guide rail surface until the plastic slide blocks 22 of two assembled floorboards 100 are engaged with each other to be positioned.

The particleboard layer 13 of the floorboard main body 1 of the present invention can be formed by compressed wood chips and resin, or compressed bamboo chips and resin, or staggered straws and resin. This saves the material of wood greatly and decreases the amount of resin, achieving a higher level of environmental protection. The plastic edge frame 2 is configured to wrap the periphery of the floorboard main body 1. On the one hand, it is not easy to evaporate toxic gas and it is better for environmental protection, on the other hand, there is no need for the floorboard main body 1 to have the arrangement of tongue-and-groove. The requirement for the strength of the floorboard main body 1 is lower. The laminated particleboard layer 13 fully meets the requirements of the use of floorboards.

An outer edge of the plastic slide block 22 is provided with a first flange 221 upward and a first groove 222 formed at an inner side of the first flange 221. The guide rail surface is provided with a second flange 211 downward and a second groove 212 formed at an inner side of the second flange 211. The first flange 221 is slidably matched with the second groove 212. The second flange 211 is slidably matched with the first groove 222. The first flange 221 and the second flange 211 are disposed in a discontinuous relationship. The length of the spaced portion is equal to or slightly greater than the length of the continuous portion. Through the flange to match the groove, the slide is smoother. It is beneficial for the operation of assembly. Besides, the first flange 221 and the second flange 211 are disposed in a discontinuous relationship.

The length of the spaced portion is equal to or slightly greater than the length of the continuous portion. It is beneficial for the operation of disassembly. When the flange is moved backward in the groove to the spaced portion, two floorboards will separate from each other.

The plastic slide block 22 has a rectangular shape and is formed with a chamfer 223 at an outer side thereof. The back of the plastic slide block 22 is provided with a recess 224. When two floorboards are assembled to engage with each other to be positioned, the chamfer 223 is adapted to increase the binding force of the two floorboards, not forming a dead space which makes the operation of disassembly laborious. The recess 224 disposed at the back of the plastic slide block 22 won't impact the strength of the plastic slide block 22 and can save the material.

As described above, the periphery of the floorboard of the present invention is combined with the plastic edge frame, without the arrangement of tongue-and-groove, so as to supplement the strength of the particleboard layer. The top surface of the plastic edge frame is hidden under the decoration layer.

The plastic edge frame is designed to be a downward hidden structure, not exposing to influence the appearance of the floorboard. The present invention can lower the cost, and be assembled and disassembled easily and environmentally-friendly, and prolong the service life of the product. Furthermore, the main body layer of the floorboard can be constituted by a particleboard layer, a density fiberboard layer, a multi-layer solid wood board layer, and the like. There are various forms. The particleboard layer can be a wood particleboard layer, a bamboo particleboard layer, or a straw particleboard layer. It is very convenient to get the material of the floorboard, so the cost of the floorboard can be decreased greatly to achieve a higher level of environmental protection.

The present invention can be applied to a density fiberboard and a multi-layer solid wood board. The floorboard main body of the aforesaid embodiment is replaced with a density fiberboard and a multi-layer solid wood board, and the other configurations are the same. That is to say, the floorboard main body comprises a wear-resisting layer, a decoration layer, a density fiberboard layer, and a balanced layer which are arranged from up to bottom. The top surface of the plastic edge frame is hidden under the decoration layer. Alternatively, the floorboard main body comprises a wear-resisting layer, a decoration layer, a multi-layer solid wood board layer, and a balanced layer which are arranged from up to bottom. The multi-layer solid wood board layer is laminated by multiple solid wood board layers arranged in an interlacing way. The top surface of the plastic edge frame is hidden under the decoration layer, so that the plastic lock of the floorboard formed by the density fiberboard or the multi-layer solid wood board won't expose to influence the appearance of the floorboard.

Furthermore, the wear-resisting layer of the present invention can be a wear-resisting paint layer or an aluminum oxide layer. The decoration layer can be a decoration paper layer or a veneer layer.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A floorboard, comprising a floorboard main body and a plastic edge frame comprising a downward vertical structural portion which is fixedly mounted to and circumferentially surrounds a periphery of the floor main body with an uppermost portion of said downward vertical structural portion terminating at an elevation equal to that of an uppermost portion of one of a fiberboard layer and a particleboard layer, a back of the plastic edge frame being provided with a guide rail extending circumferentially around the periphery of the floorboard main body, the guide rail being provided with plastic slide blocks arranged evenly on the guide rail in a predetermined direction along the guide rail and each having an outer end extending out of a guide rail surface of the guide rail, wherein the plastic slide blocks of one of two opposite sides of the floorboard main body are adapted to be positioned on the guide rail of the plastic edge frame of another corresponding adjacent floorboard, such that the plastic slide blocks abutting and positioned against each other in the predetermined direction, wherein a spacing length defined between two adjacent ones of the plastic slide blocks in the predetermined direction along the guide rail is greater than a length of each of the plastic slide blocks measured in the predetermined direction, the plastic slide blocks of the two opposite sides of the floorboard main body being not symmetric with respect to each other and shifted away from each other in the predetermined distance such that the plastic slide blocks of one of the two opposite sides of the floorboard main body are positionable against the slide blocks of said another floorboard in the predetermined direction.

2. The floorboard as claimed in claim 1, wherein the floorboard main body comprises a wear-resisting layer, a decoration layer, a particleboard layer, and a balanced layer which are arranged from up to bottom, and a top surface of the plastic edge frame is hidden under the decoration layer.

3. The floorboard as claimed in claim 2, wherein the particleboard layer is one of a wood particleboard layer, a bamboo particleboard layer, and a straw particleboard layer.

4. The floorboard as claimed in claim 1, wherein the floorboard main body comprises a wear-resisting layer, a decoration layer, a density fiberboard layer, and a balanced layer which are arranged from up to bottom, and a top surface of the plastic edge frame is hidden under the decoration layer.

5. The floorboard as claimed in claim 1, wherein the floorboard main body comprises a wear-resisting layer, a decoration layer, a multi-layer solid wood board layer, and a balanced layer which are arranged from up to bottom, and a top surface of the plastic edge frame is hidden under the decoration layer.

6. The floorboard as claimed in claim 5, wherein the multi-layer solid wood board layer is laminated by multiple solid wood board layers arranged in an interlacing way.

7. The floorboard as claimed in claim 2, wherein the wear-resisting layer is one of a wear-resisting paint layer and an aluminum oxide layer, and the decoration layer is one of a decoration paper layer and a veneer layer.

8. The floorboard as claimed in claim 4, wherein the wear-resisting layer is one of a wear-resisting paint layer and an aluminum oxide layer, and the decoration layer is one of a decoration paper layer and a veneer layer.

9. The floorboard as claimed in claim 5, wherein the wear-resisting layer is one of a wear-resisting paint layer and an aluminum oxide layer, and the decoration layer is one of a decoration paper layer and a veneer layer.

10. The floorboard as claimed in claim 1, wherein a front side of a middle section of an outer edge of each of the plastic slide blocks is provided with a first flange, such that a first groove is formed at an inner side of the first flange, the back of the guide rail surface being provided with second flanges spaced from each other in the predetermined direction, such that a second groove is formed at an inner side of the second flanges, wherein the first flange is slidably receivable in the second groove of said another floorboard, and the second flange is slidably receivable in the first groove of said another floorboard, the first flanges being arranged in a discontinuous and spaced relationship, such that a spacing distance between two adjacent ones of the first flanges is equal to or slightly greater than a length of the first flanges in the predetermined direction, a spacing distance between two adjacent ones of the second flanges being equal to or slightly greater than a length of the second flanges in the predetermined direction.

11. The floorboard as claimed in claim 10, wherein each of the plastic slide blocks has a rectangular shape that has an outer side formed with a chamfer at each of two ends thereof in the predetermined direction, and a back of each of the plastic slide blocks is provided with a recess.

* * * * *